United States Patent [19]

Combe et al.

[11] Patent Number: 5,016,709

[45] Date of Patent: May 21, 1991

[54] PROCESS FOR ASSISTED RECOVERY OF HEAVY HYDROCARBONS FROM AN UNDERGROUND FORMATION USING DRILLED WELLS HAVING AN ESSENTIALLY HORIZONTAL SECTION

[75] Inventors: Jean Combe, Bougival; Gerard Renard, Rueil-Malmaison; Emmanuel Valentin, Le Vesinet, all of France

[73] Assignee: Institut Francais du Petrole, Rueil-Malmaison, France

[21] Appl. No.: 361,312

[22] Filed: Jun. 5, 1989

[30] Foreign Application Priority Data

Jun. 3, 1988 [FR] France ..... 88 07460

[51] Int. Cl.[5] ..... E21B 43/24; E21B 43/30

[52] U.S. Cl. ..... 166/245; 166/50; 166/52; 166/272

[58] Field of Search ..... 166/50, 52, 245, 258, 166/272, 302

[56] References Cited

U.S. PATENT DOCUMENTS

| | | | |
|---|---|---|---|
| 1,660,187 | 2/1928 | Ehrat | 166/52 X |
| 3,180,413 | 4/1965 | Willman | 166/272 |
| 3,572,436 | 3/1971 | Riehl | 166/272 X |
| 3,692,111 | 9/1972 | Breithaupt et al. | 166/272 X |
| 4,249,604 | 2/1981 | Frazier | 166/272 X |
| 4,265,485 | 5/1985 | Boxerman et al. | 166/272 X |
| 4,325,432 | 4/1982 | Henry | 166/245 |
| 4,390,067 | 6/1983 | Willman | 166/245 |
| 4,410,216 | 10/1983 | Allen | 166/50 X |
| 4,501,326 | 2/1985 | Edmunds | 166/272 |
| 4,577,691 | 3/1986 | Huang et al. | 166/50 X |
| 4,598,770 | 7/1986 | Shu et al. | 166/245 |
| 4,611,855 | 9/1986 | Richards | 166/50 X |
| 4,637,461 | 1/1987 | Hight | 166/245 |
| 4,662,441 | 5/1987 | Huang et al. | 166/50 X |
| 4,700,779 | 10/1987 | Huang | 166/263 |
| 4,705,431 | 11/1987 | Gadelle | 405/267 |
| 4,718,485 | 1/1988 | Brown et al. | 166/50 |
| 4,766,958 | 8/1988 | Faecke | 166/272 X |

OTHER PUBLICATIONS

Mahony, B. J., "Horizontal Drilling use on the Rise: Why and How", *World Oil*, Oct. 1988, pp. 45–57, copy in 166–50.

*Primary Examiner*—George A. Suchfield

*Attorney, Agent, or Firm*—Antonelli, Terry, Stout & Kraus

[57] ABSTRACT

A process for the assisted recovery of heavy hydrocarbons from an underground formation having a plurality of superimposed reservoirs for the hydrocarbons involves arranging horizontal sections of a plurality of wells so that a first well of a first series of wells extend into a reservoir and is located essentially vertically below a horizontal section of a second well located in an immediately adjacent reservoir, with the first well being used as a steam injection well and the second well being used as a hydrocarbon-producing well.

6 Claims, 2 Drawing Sheets

PROCESS FOR ASSISTED RECOVERY OF HEAVY HYDROCARBONS FROM AN UNDERGROUND FORMATION USING DRILLED WELLS HAVING AN ESSENTIALLY HORIZONTAL SECTION

BACKGROUND OF THE INVENTION

The present invention relates of production of heavy hydrocarbons contained in an underground formation by an assisted recovery process using wells drilled with an essentially horizontal section, said wells having an initial practically vertical section starting at the surface of the ground, followed by an inclined or horizontal section extending into the formation.

Extraction of heavy hydrocarbons from an underground formation implies production mechanisms designed essentially to reduce viscosity and to cause displacement followed by aspiration of the heavy oil into wells, and finally bringing it to the surface. There are two methods for generating the energy required for displacement: producing this energy at the surface, in the case of injection of hot fluids (U.S. Pat. No. 4,325,432) or the creation of such fluids in the formation, as in the case of in situ combustion (U.S. Pat. No. 4,501,326).

This principle of reducing the viscosity of heavy oil by heating is generally accompanied by careful selection of well-drilling locations to use the injected energy with increased efficiency.

Hence, development in recent years has stressed the use of wells drilled horizontally in a layer of a formation to increase production yield. Horizontal wells have made it possible (a) to reach reservoirs of hydrocarbons in locations sometimes inaccessible to vertical wells, and (b) have shown improved profitability in production and extraction of petroleum located in certain types of formations.

Hence, initial developments were directed at using horizontal wells to produce heavy hydrocarbons by injecting steam.

Steam injected into a will diffuses in the hydrocarbon, reducing its viscosity and starting its displacement toward a producing well by thermal transmission.

A method of this kind is described in U.S. Pat. No. 4,700,779, in which the reservoir containing the heavy hydrocarbon is pierced by a series of wells with horizontal drains whose horizontal sections are parallel to one another and extend longitudinally in the reservoir.

The hydrocarbon production process is worked by activating a first well in a first stage and a second well located at one end of the formation by injecting steam, and capturing the hydrocarbon in a second step after starting heating in the second well immediately adjacent, which is then transformed from an injector into a producer.

When the opening formed by the steam reaches the second well, steam injection is suspended in the first well and replaced by water injection to maintain sufficient pressure in the reservoir.

It is then sufficient to shift the functions of the wells to extract, at a third well, the hydrocarbon set in motion by the injection of steam at the second well.

Such a technique has been used successfully for production from a hydrocarbon reservoir, but this system can be used only when the hydrocarbon is contained in a single reservoir, while in many cases it is divided among reservoirs superimposed on one another and separated by impermeable secondary rocks. In such cases, each reservoir must be treated individually by the process described above, which rapidly leads to complications in controlling the wells (transmission of commands to switch from production to injection and vice versa) when the number of stratified layers is large.

SUMMARY OF THE INVENTION

The present invention is intended to overcome the above shortcomings when it is desired to use wells with horizontal drains to inject steam through a formation of superimposed reservoirs, and thus eliminate the use of wells alternately for injection and production. In addition, the present invention advantageously makes use of the heat losses into the secondary rocks that occur in conjunction with the injection of steam; in the patent cited above, these losses constitute a major disadvantage because they reduce the production of a well.

The essence of the present invention is the drilling of wells with horizontal drains in each of the superimposed reservoirs, said drains being located in parallel vertical planes, followed by the use of one well for steam injection, with the wells located in the two adjacent layers then being producers.

With this arrangement, heat losses propagated vertically through the rocks are used to ensure acceleration of the heavy hydrocarbon to the producing wells located in the contiguous reservoirs.

The start of production, always accomplished by displacement of fluids, is thus speeded up by the transmission of heat. Hence, the goal of the present invention is to provide a process for assisted recovery of heavy hydrocarbons from underground formations by drilling wells each with an essentially horizontal section, said wells having, at the point where they leave the surface of the ground, an initial practically vertical section, followed by an inclined or horizontal section extending into the formation composed of reservoirs of said hydrocarbons, wherein:

a jet of steam is injected into the formation through a first series of horizontal wells;

the hydrocarbon is extracted from the formation by a second series of horizontal wells, characterized by the formation being composed of at least two superimposed reservoirs separated by secondary rocks, with the horizontal section of a first well extending into a reservoir essentially perpendicular to the horizontal section of a second well located in an immediately adjacent reservoir, said first well being used as a steam-injection well and the second well as a hydrocarbon-producing well.

In this manner, the hydrocarbon is recovered in the simplest way by two wells with horizontal drains located essentially one above the other in two superimposed layers, the first being the injector and the second the producer, with the injection of steam involving heat transmission through the rock separating them and rapidly causing the start of production in the second well.

According to a particular embodiment of the invention, two horizontal well sections are disposed parallel and in succession in a regular fashion within one reservoir, and the two successive wells located along said reservoir are operated so that one well is for injecting steam and the other well is for--; producing hydrocarbons.

Production capacities are increased by using in addition, a plurality of wells in each reservoir, spaced at regular intervals, said wells acting in succession as producers and injectors in a given reservoir.

Advantageously, the formation comprises a succession of superimposed reservoirs, and a network of wells is formed in a vertical cross section of the formation, with a horizonal section that is essentially orthogonal and extends (a) in a transverse direction at the level of each reservoir and (b) in another, longitudinal direction in said reservoir, and a first series of wells is operated to inject steam, said wells being arranged in a quincunx in this network and a second series of wells being used for production and likewise arranged in a quincunx, complementary to the first. The present invention also includes an assembly for drilling wells in a deep horizontal zone for working the process described above, characterized by the horizonal injecting and producing wells being arranged in quincuncial patterns within the networks formed in the successive vertical planes of the formation.

Advantageously, the superimposed reservoirs are essentially 10 meters thick and the rocks separating said reservoirs are 10 meters thick at most.

Finally, in a preferred embodiment, the distance separating two contiguous parallel horizonal sections in a given reservoir is essentially 100 m.

One specific embodiment of the invention will now be described in greater detail, and will make it easier to understand the essential features and advantages, it being understood that this embodiment has been chosen as an example that is not limitative.

BRIEF DESCRIPTION OF THE DRAWINGS

The assembly of drilling wells for carrying out the process of the invention is illustrated in the accompanying drawings wherein--.

DETAILED DESCRIPTION OF THE INVENTION

Figure 1:
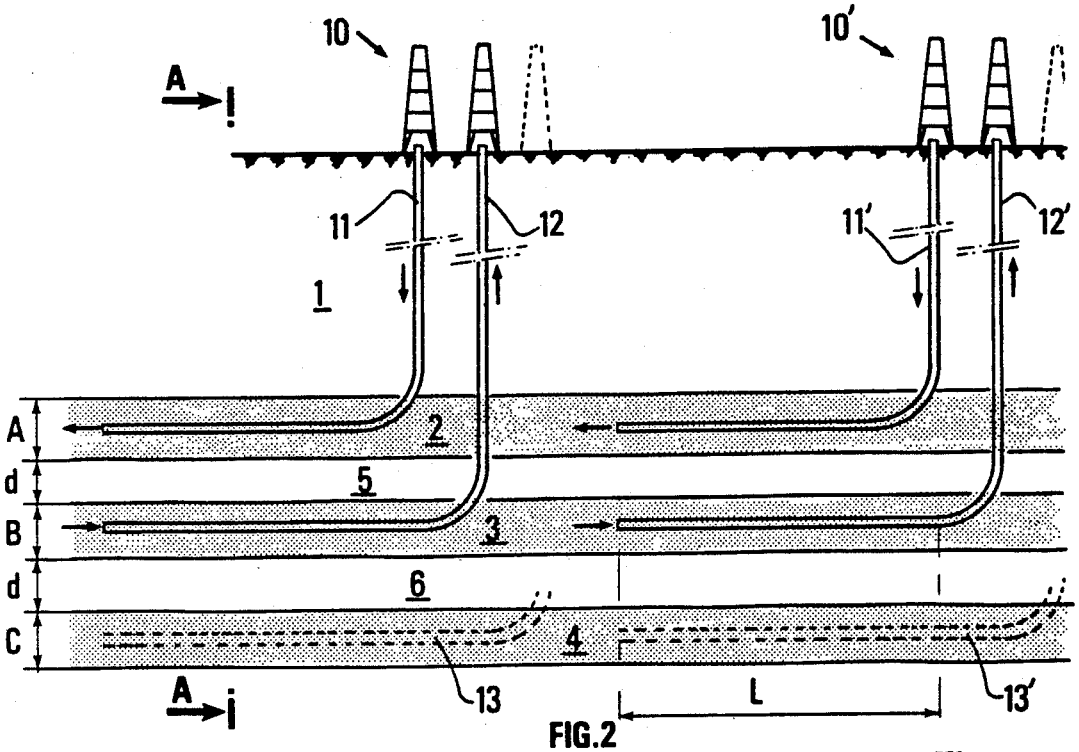
FIG. 1 shows a longitudinal section through the formation, with wells with horizontal drains.

FIG. 1 shows a lengthwise section through a geological formation 1 comprising, at a depth, stratified reservoirs 2, 3, and 4 containing heavy hydrocarbons. These reservoirs are superimposed on one another and separated by rocks 5 and 6 composed of impermeable layers such as clay through which the hydrocarbon does not pass.

According to the present invention, it is desired to develop a process of recovery from these reservoirs by extraction to the surface.

In a preliminary step, wells 11, 12, and 13 are drilled, which, starting at the surface of the ground, have an initial practically vertical section, followed by an inclined or horizontal section extending into a reservoir in the formation, said wells being surmounted by drilling towers or derricks 10. Thus, a first well 11 is drilled so as to terminate in first layer 2, a second well 12 in second layer 3, and so on, each reservoir being provided with a horizontal drain.

To cover the entire surface of the formation in one longitudinal direction, a second series of wells 11', 12', and 13' is drilled behind first wells 11, 12, and 13 and surmounted by drilling towers or derricks 10'.

In normal applications of horizontal wells, the drains can reach lengths L extending horizontally for several hundred meters and for a non-limitative average distance of 500 meters.

Figure 2:
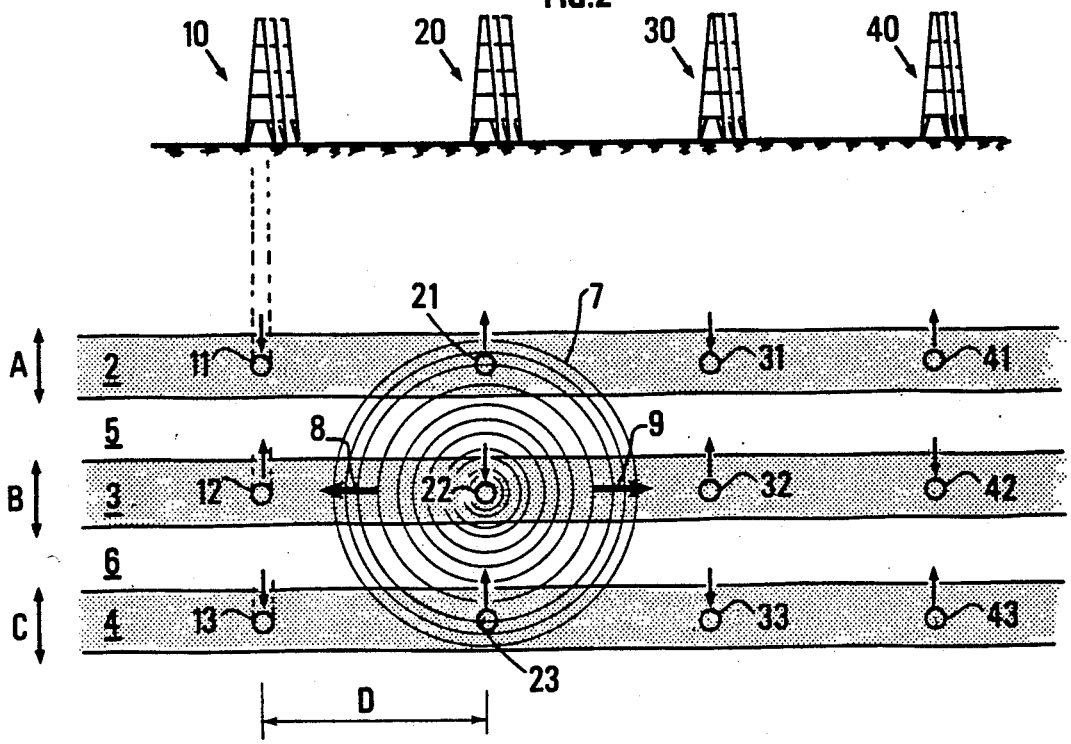
FIG. 2 shows a cross section through the formation along the plane of section A—A.

Wells 11, 12, and 13 are drilled starting at a geographical point selected to allow their horizontal drains to be aligned practically parallel in the vertical direction, i.e. so that they are all practically perpendicular to corresponding derricks 10 and as shown in FIG. 2 are located within the same vertical plane--. However, the present invention could be used equally well if the drains were spread a few meters apart from this vertical direction, i.e. from the vertical plane--.

FIG. 2 shows a cross section of the formation along the plane of section A—A. In this figure we see the first series of wells 10, 11, and 12 with horizontal sections. This figure shows the openings of these wells and the shafts terminating at derricks 10. In a preferred non-limitative version, the three drains of wells 11, 12, and 13 are mutually perpendicular. This drawing includes arrows pointing upward or downward to indicate whether the wells are for injecting steam (downward-pointing arrows) or for production (upward-pointing arrows).

Well 11 serves as a steam injector when this steam enters the reservoir and diffuses heat energy which propagates in all directions, especially through rock 5.

When the heat energy reaches reservoir 3 immediately adjacent to reservoir 2 where it is being emitted, heating takes place in the zone adjacent to producing drain 12, so that extraction can begin.

This heat-diffusion phenomenon is shown for well 22, around which the progress of heating is represented by concentric circles 7.

It can be seen that well 22 acts on the two wells 21 and 23 located in each of the reservoirs in layer 2 above as well as layer 4 below.

Of course, the normal entrainment phenomena caused in reservoirs by displacement of fluid act as shown by horizonal arrows 8 and 9, but this action is relatively late and does not supplement the heat induction phenomena until a considerable time has elapsed.

Thus, in the plane of a vertical section through the formation, there is a network of wells, each link of which is composed of a horizonal drain, said network extending in two orthogonal directions, the first direction being that of the series of wells vertically below the geographical point, and the second direction being longitudinal at a given depth along a reservoir. Within this network, a first series of wells operated as steam injectors is arranged in a quincunx in this network, and a second series of producing wells is likewise arranged in a quincunx, in an arrangement that is complementary to the first series.

This type of network is formed in successive planes of the formation to cover the entire oil field.

To provide some idea of size, the present invention is used preferentially when the reservoirs have a thickness A, B, C on the order of 10 meters and when they are separated by rocks with a thickness d of at least 10 m.

Finally, drilling distance D is selected, separating the wells located in the same reservoir by a distance on the order of 100 m.

Figure 3:
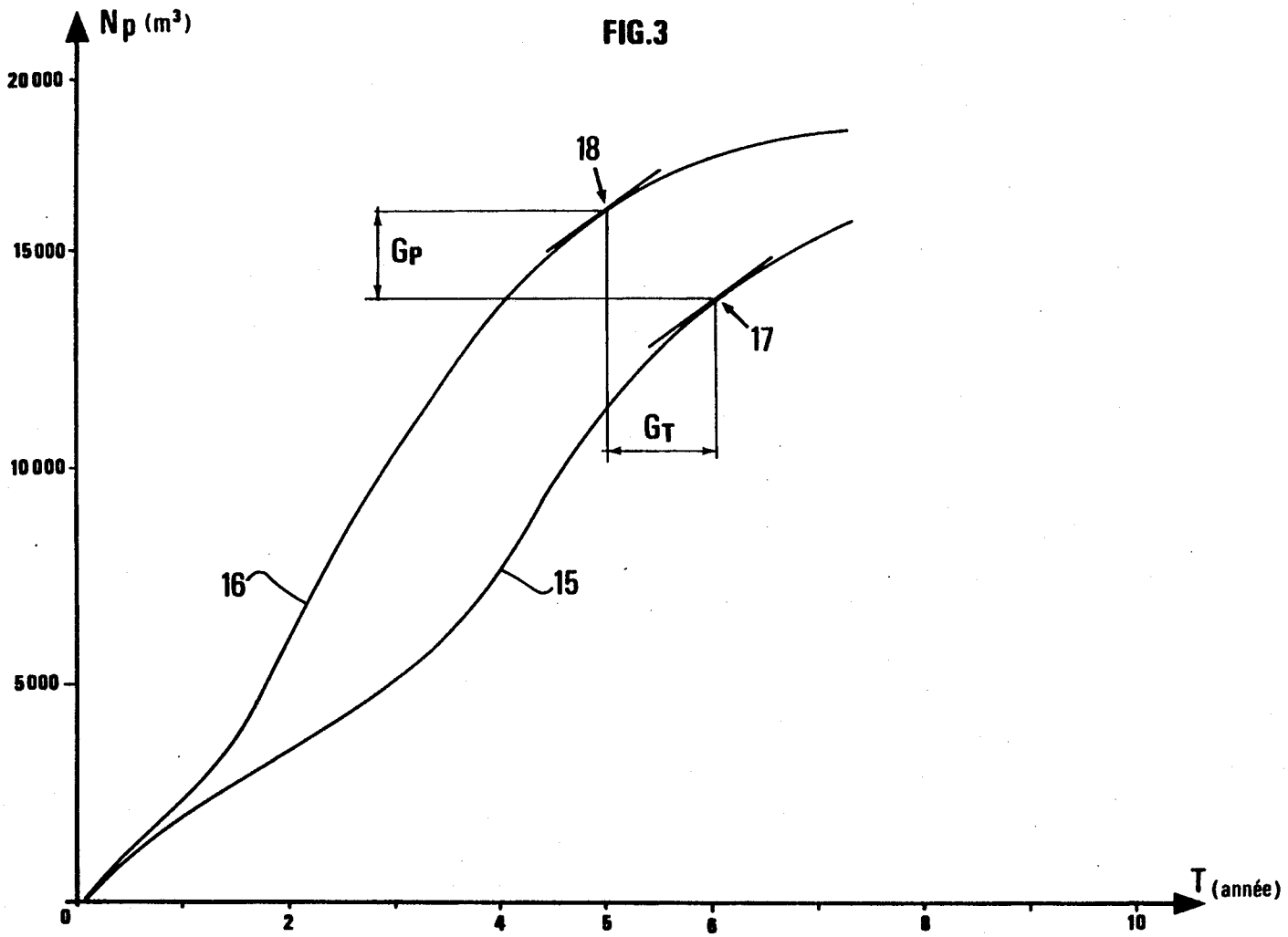
FIG. 3 shows the comparative hydrocarbon production curves as a function of time, for an ordinary well and a well worked according to the present invention.

FIG. 3 shows theoretical curves representing the cumulative production of a well as a function of time T expressed in operating years.

Curve 15 is for a producing well as commonly used in the prior art, while curve 16 is for a producing well located in a network of steam-emitting wells and producing wells as described in the present invention.

It has been found that production practically doubles in the second year in comparison to the wells formerly used. After four years, production is still double.

Finally, if we compare the curves at tangents with identical slopes (points 17 and 18) corresponding to the end of exploitation of the well, we find that a gain $G_T$ in time of one year has been achieved. Production on curve 18 ends after 5 years instead of 6 years as before.

With this gain in time, production reflects a gain $G_p$ corresponding to practically 15% of the cumulative production when the well is shut down.

The present invention applies in an especially favorable manner to the production of heavy hydrocarbons with densities between 0.93 and 1. For lower densities, using the process according to the present invention is less useful because the natural flow of the producing well is fast enough not to require external excitation like heating.

Of course, the invention is not limited in any way by the details specified in the above or by the details of the specific embodiment chosen to illustrate the invention. All manner of variations can be made in the specific embodiment described above as an example and in its structural elements without thereby departing from the scope of the invention. Thus, the latter includes all means comprising equivalent techniques for the means described, as well as their combinations.

We claim:

1. A process for assisted recovery of heavy hydrocarbons from an underground formation having an essentially horizontal section by drilled wells, said wells having, starting at the surface a substantially vertical initial section followed by an inclined or horizontal section extending into the formation, said formation comprising at least two reservoirs of said hydrocarbons which are superimposed and separated by an impermeable secondary rock-containing layer, which comprises injecting a jet of steam into the formation through a first series of horizontal wells arranged in the at least two reservoirs; extracting the hydrocarbon from the formation by a second series of horizontal wells arranged in the at least two reservoirs, a horizontal section of a first well of the first series of wells extending into a reservoir and being located essentially vertically below a horizontal section of a second well of the second series of wells located in an immediately adjacent reservoir; and using said first well as a steam-injection well and said second well as a hydrocarbon-producing well.

2. A process for assisted recovery of heavy hydrocarbons according to claim 1, wherein at least two horizontal sections of wells, one section being of the first series and another section being of the second series of wells, are arranged parallel to each other in succession within one reservoir and one of the two successive wells arranged within said reservoir is used as a steam-injection well and the other is used as a hydrocarbon-producing well.

3. A process for assisted recovery of hydrocarbons according to claim 1 or claim 2, wherein the formation having at least two superimposed reservoirs contains a network of the wells having horizontal sections arranged in a plane extending vertically through the formation and extending essentially orthogonally (a) in a transverse direction at a level of each reservoir and (b) in another direction longitudinal to said reservoirs, said process further comprising arranging the horizontal sections of the first series of wells acting as steam-injection wells in a quincunx in said network and arranging the second series of wells acting as hydrocarbon-producing wells in a quincunx complementary to said first series of wells.

4. An assembly of drilling wells for the assisted recovery of heavy hydrocarbons from a deep horizontal underground formation, said formation including a plurality of superimposed reservoirs of said hydrocarbons separated by impervious secondary rock-containing layers, which comprises a plurality of wells each having, starting at the surface, a practically vertically initial section followed by an inclined or horizontal section extending into the formation, a horizontal section of a first well extending into a reservoir and being located essentially vertically below a horizontal section of a second well located in an immediately adjacent reservoir, said first well serving as a steam-injection well and said second well serving as a hydrocarbon-producing well; the horizontal sections of the wells for steam injection and of the wells for hydrocarbon production each being arranged quincuncially in a network formed in successive vertical planes extending through the formation, with horizontal sections of the wells located in a reservoir being arranged parallel to each other.

5. An assembly of drilling wells according to claim 4, wherein the superimposed reservoirs have thicknesses of essentially 10 meters and the impervious secondary rock-containing layers separating said reservoirs are at most 10 meters thick.

6. An assembly of drilling wells according to claim 4 or claim 5, wherein distance separating two contiguous parallel horizontal sections located within one reservoir is essentially 100 meters.

* * * * *